United States Patent [19]

Munn

[11] 4,210,059

[45] Jul. 1, 1980

[54] SERVO-RELEASE MECHANISM

[75] Inventor: Gerhard Munn, Meerbusch, Fed. Rep. of Germany

[73] Assignee: Rheinmetall GmbH, Duesseldorf, Fed. Rep. of Germany

[21] Appl. No.: 943,643

[22] Filed: Sep. 19, 1978

[30] Foreign Application Priority Data

Sep. 20, 1977 [DE] Fed. Rep. of Germany ..... 2742241

[51] Int. Cl.[2] ..... F41D 11/02

[52] U.S. Cl. ..... 89/132

[58] Field of Search ..... 89/125, 132

[56] References Cited

U.S. PATENT DOCUMENTS 3,918,347 11/1975 Pierre et al. ..... 89/142

*Primary Examiner*—Stephen C. Bentley

[57] ABSTRACT

An improved servo-release mechanism for an automatic firearm. The reciprocally movable breech body coacts with the first arm of a rockable catch lever to hold the breech body in a predetermined position. An adjusting member is slidably movably mounted parallel to the direction of movement of the breech body. A kinetic energy absorption device forms part of the servo-release mechanism. The kinetic energy absorption device has a pair of members having mating contact surfaces which, when matingly contacting each other, effect a torque transfer. A pair of coil springs are respectively axially mounted on the pair of members. One of the members coacts with the reciprocating breech body and the other coacts with the adjusting member which in turn coacts with the first and a second arm of the catch lever. By selectively releasing the energy absorption device the automatic firearm can be singly or continuously fired.

6 Claims, 5 Drawing Figures

SERVO-RELEASE MECHANISM

BACKGROUND OF THE INVENTION

This invention pertains to a servo-release for automatic firearms, in particular a machine cannon.

Automatic firearms generally include a servo-release which, by means of an as small as possibly externally applied force, brings about a release of a breech body for firing, which reciprocally moves forwardly and rearwardly along a defined path. The reciprocal movement of the breech body serves to fire the weapon and to catch the breech body for purposes of interrupting the firing. In view of the necessary features for an automatic firearm, for example multiple application, high firing force, ease of manipulation, reliability, minimal malfunctioning and safety, the servo-release is of particular significance.

There is, for example, described in German published patent application No. 14 539 10 a servo-release of the aforedescribed known type, with which a firing of the breech body in the catch position can be attained without the use of servo-braking parts and wherein a release is accomplished which only requires a reduced force. There is mounted between one element, which gives up its recoil energy as auxiliary energy (in this case a breech block) and a storage spring for the auxiliary energy, on the one hand, as well as, on the other hand, between the storage spring and a catch lever actuated by the stored auxiliary energy, a plurality of partially spring biased levers. This known servo-release has a large number of individual interacting parts which is, with respect to the manufacture of these parts, their mounting and the spatial requirements in the weapon a significant drawback. In view of the complexity of this known construction there occur an inordinately high number of disadvantageous malfunctions which influence negatively the efficiency, reliability and availability of this type of known weapon. Furthermore, the servo-release of this known weapon does not make possible a sufficient storage possibility for purposes of avoiding unintentional firing, for example during impact blows during the transporting of the weapon, so that obvious safety requirements are not sufficiently fulfilled.

There is also already known a servo-release having comparatively a lower number of individual parts which also occupy a smaller space, and such a known servo-release is, for example, disclosed in German published application 23 53 870. However, this known servo-release also has some distinct drawbacks which negatively influence the functional safety of the weapon in a very sensitive manner. It includes a storage spring adapted to be biased by the recoiling breech block body which acts as a return positioning means for a control arrangement for pivoting a catch lever. The catch lever is loaded by a strong spring which repositions the catch cam into the firing position. Although the control arrangement for actuating the catch lever for firing requires only a reduced to be introduced force, it must, however, overcome the strong return positioning force of the afore-mentioned spring from interrupting the firing force. Additionally, the control arrangement forming the operative chain of the weapon does not provide a continuously reliable obligatory effect. Thus, it surrounds an element for taking off the auxiliary energy from the recoiling breech block body and a transfer element for biasing the storage spring. The extracting element grips, in opposition to a deflectable spring force into the path of movement of the breech body and is coupled via a further spring with the transfer element. A rupture of the last-mentioned spring during continuous firing causes the significant drawback of an unintentional continuance of firing.

In both of these known servo-release mechanisms there is built-in an individual arrangement for selecting the mode of firing (individual or continuous firing). This results disadvantageously in a further complication of the construction and thereby, in addition to the corresponding spatial requirements, to an increased servicing requirement and an increased malfunctioning frequency of an automatic firearm having the afore-described servo-release mechanism.

SUMMARY OF THE INVENTION

The invention has as its object to provide a servo-release mechanism of the afore-described type which distinguishes itself by having a reduced spatial requirement and a reduced number of parts, while being reliable, safe and simple in construction. Thereby, the afore-described drawbacks of the servo-release mechanisms of the state of the art are mitigated or eliminated.

The advance in the state of the art which is rendered by this invention becomes evident from the object of the invention. In addition thereto, the selection means for type of firing can advantageously be mounted securely and non-rockably so that the servo-release mechanism in accordance with the invention can be utilized universally on automatic weapons having straight open breech (the type of firing selection arrangement forms part of a further patent application co-assigned with this application). The servo-release mechanism of this invention dispenses with certain finishing and construction tolerances, so that the servo-release mechanism operates reliably even when disturbing influences, for example penetration of foreign bodies, occurs.

BRIEF DESCRIPTION OF THE DRAWINGS

Other objects and advantages of the present invention will become apparent from the following description taken in connection with the accompanying drawings wherein there is set forth by way of illustration an example of a certain embodiment of this invention.

The drawings constitute a part of the specification and includes an exemplary embodiment illustrating various objects and features of the servo-release and mounting structure of the present invention.

Figure 1:
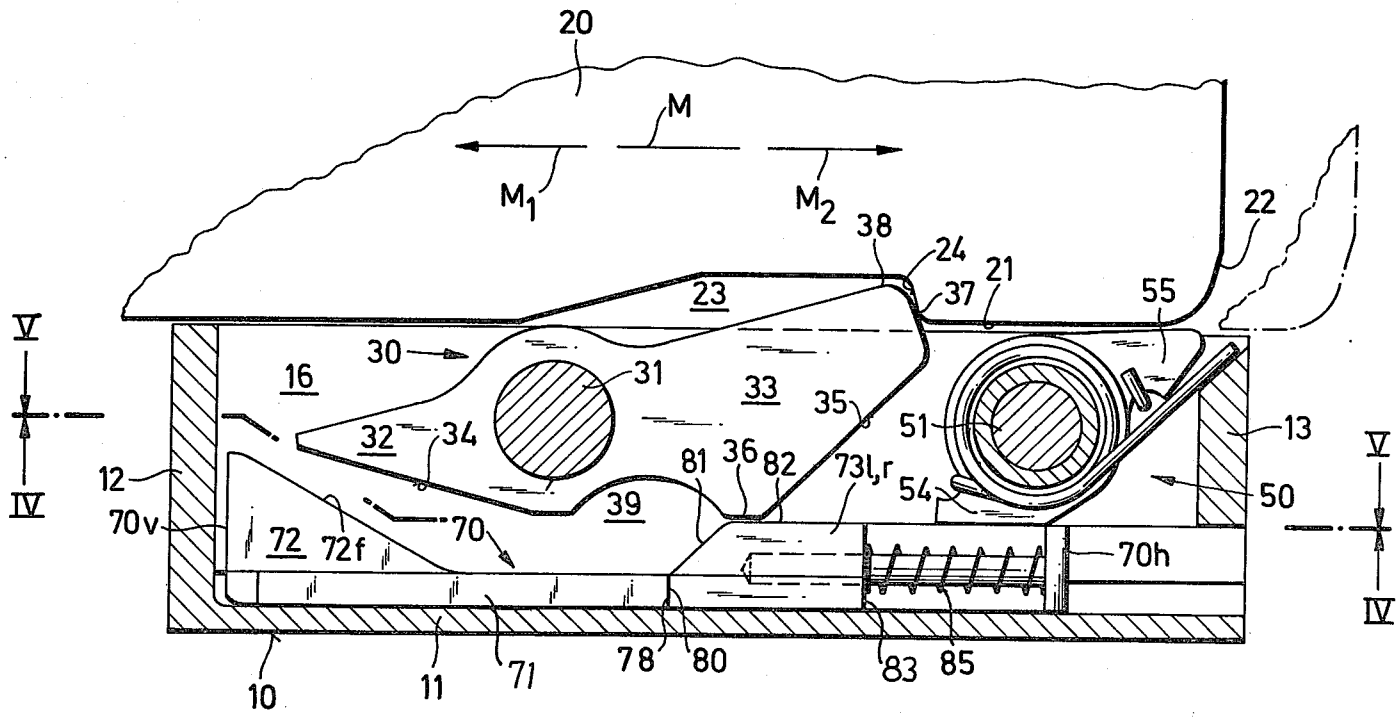
Figure 2:
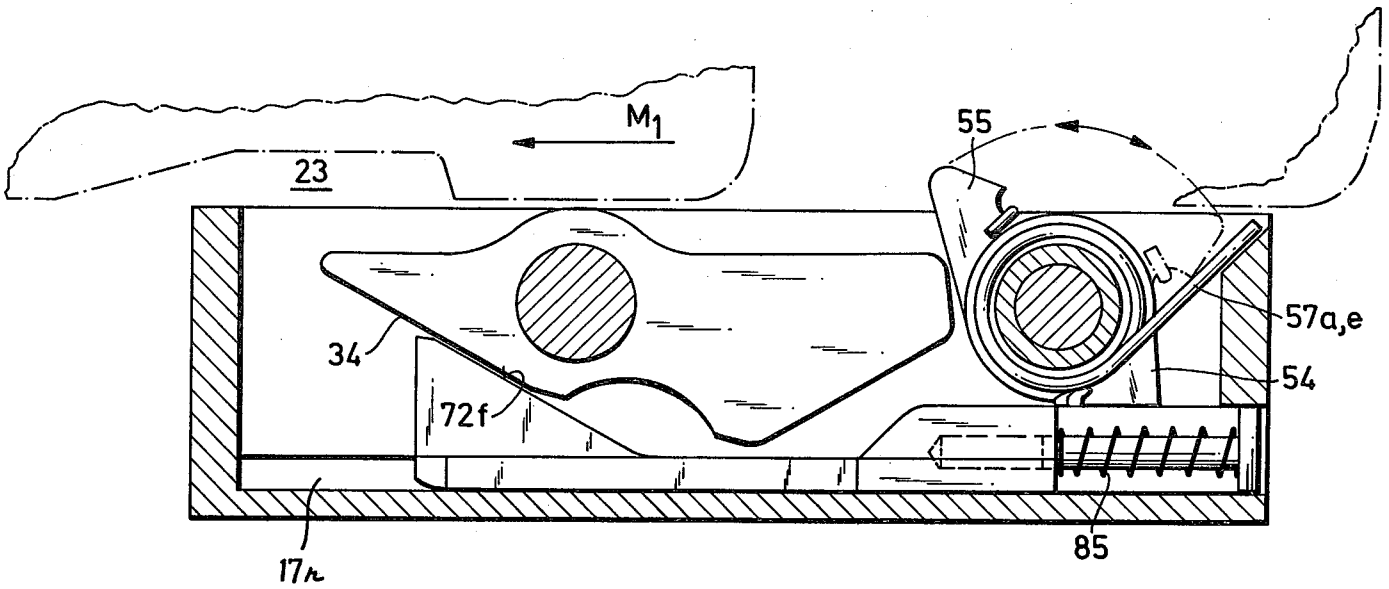
Figure 3:
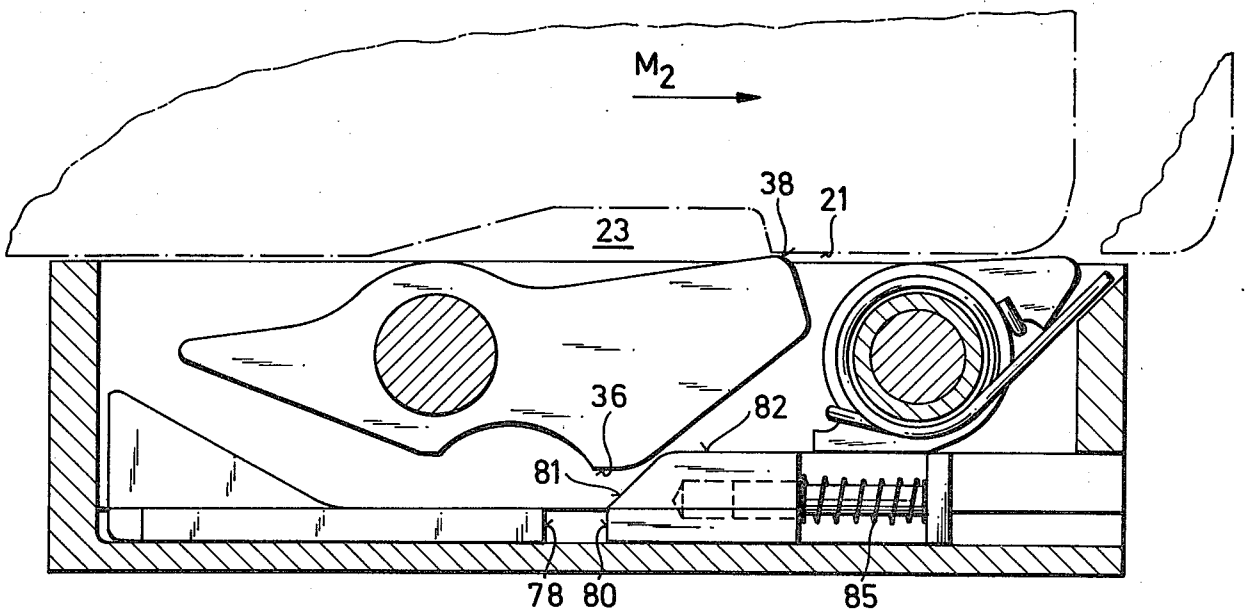
Figure 4:
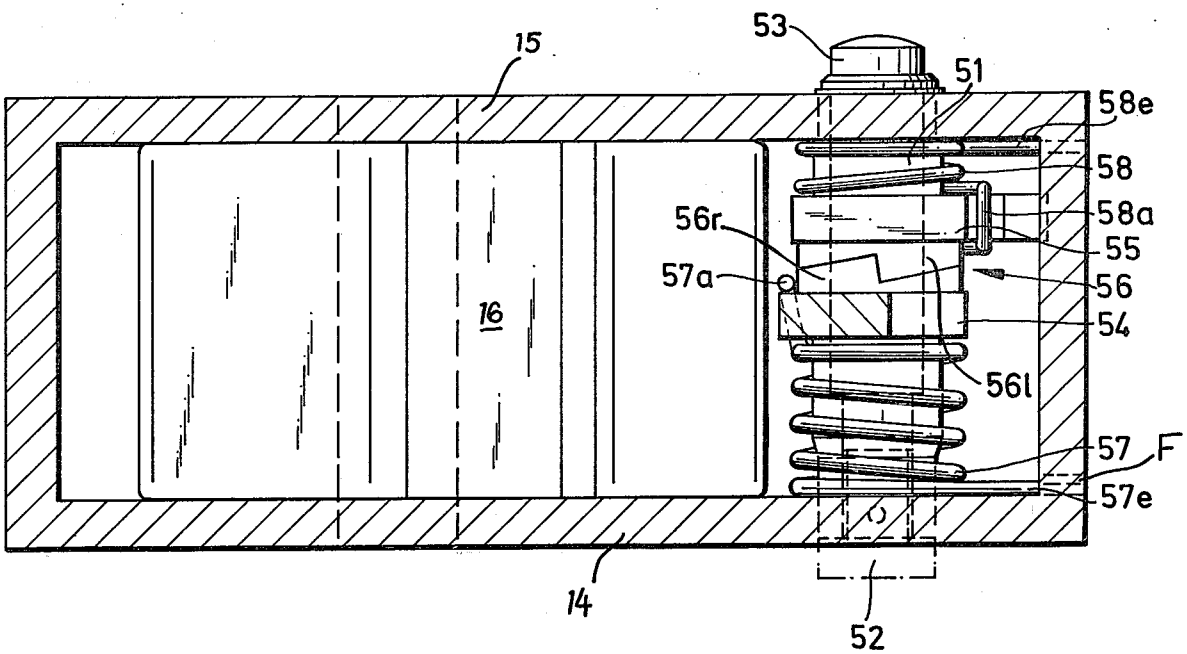
Figure 5:
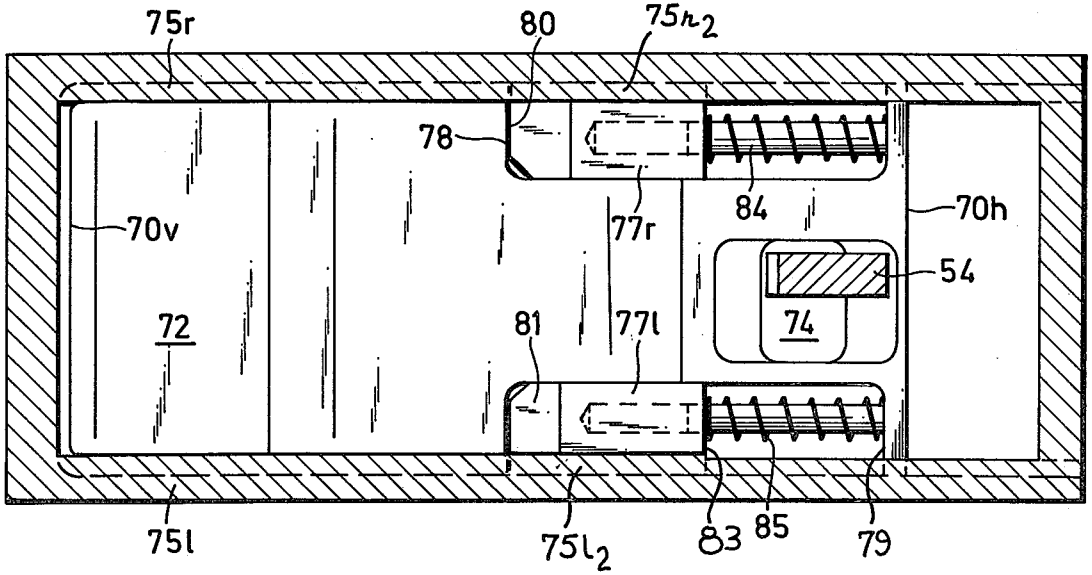

In the drawing there is illustrated in a schematic manner important parts forming the arrangement of the invention. Certain other parts which do not affect the subject matter of the invention have not been illustrated for sake of clarity:

FIG. 1 illustrates in elevation and partial cross-section a servo-release mechanism in accordance with the invention having a breech body in the catch position;

FIG. 2 illustrates in elevation and partial corss-section a servo-release mechanism in accordance with FIG. 1 in the position in which it is situated after releasing the breech body;

FIG. 3 illustrates a servo-release mechanism in accordance with FIGS. 1 and 2 in an intermediate position, that is before reaching the catch position illustrated in FIG. 1, also in an lateral elevational cross-sectional view, wherein the cross section is taken in a plane behind the wall of a housing and parallel to the longitudinal axis of the weapon;

FIG. 4 is a cross-sectional view of the servo-release mechanism in accordance with FIG. 1, along line IV—IV; and FIG. 5 is a cross-sectional view of the servo-release mechanism in accordance with FIG. 1 along line V—V, both FIGS. 4 and 5 being plan views.

DETAILED DESCRIPTION

A housing 10 of a non-illustrated automatic weapon encloses with a longitudinal cover 11, a forward and rearward sidewall 12, 13 and a left and right sidewall 14, 15 and inner space 16, the open side of which is disposed immediately adjacent to an only partially illustrated breech body 20. The breech body 20 reciprocally moves along a path M which is parallel to the longitudinal axis (not illustrated) of the weapon. The arrow $M_1$ indicates a forward motion in the direction of a non-illustrated tube and the arrow $M_2$ illustrates a recoil motion of the breech body 20 after its unlocking. On the side confronting the housing 10 the breech body 20 has a bearing surface 21 which is provided at its rear end with a stop surface 22. The bearing surface 21 extends from the stop surface 22 to a cutout 23. The rearward border of the cutout 23 is formed by a catch shoulder 24, which is inclined forwardly from the bearing surface 21 with respect to the inner space 16 and the direction of firing. A catch lever 30 is freely rockably mounted about the fixed axis 31 in the inner space 16 and has a forwardly extending arm 32 and a rearwardly extending arm which is formed as a catch 33 adapted to coact with the catch shoulder 24. The sides of the catch lever 30 which face away from the breech body 20 are formed so that on the forward arm 32 there is provided a guide surface 34 and on the catch 33 there is formed a second control surface 35. This second control surface 35 connects a cam surface 36, which is more closely positioned relative to the axis 31, with a catch surface 37 which is more remotely positioned with respect to the axis 31. The second control surface 35 forms an optuse angle with the adjoining catch surface 37 as well as with the first control surface 34, which is separated therefrom by the cam surface 36 and the cutout 39. The upper limit of the catch surface 37 is formed as a bearing surface 38 and is most proximate to the breech body 20. In the rearward region of the inner space 16 there is mounted a coupling member 50 at a distance from the catch surface 37 with respect to the longitudinal axis of the weapon. The coupling member 50 is mounted on an axle 51 supported on the side walls 14, 15 with its ends 52, 53. First and second levers 54, 55 are mounted on the axle 51. the levers 54, 55 are positioned adjacent to each other on the axle 51 and are swingable relative to each other as well as axially slidable relative to each other. The second lever 55 coacts with the breech body 20 whereas the first lever 54 is adapted to coact with an adjusting member 70. The sides of the levers 54, 55 which confront each other and adjacent to the supporting region thereof each are formed with a half of a disengageable splint teeth coupling 56 *l*, 56 *r* which makes possible a disengageable clutch-like connection 56 between the two levers 54, 55. The coupling member 50 furthermore includes a first and a second coil spring 57, 58, which surrounds the axle 51. The first coil spring 57 is disposed between the internal surface of the left side wall 14 and the first lever 54. One end 57*a* of this first coil spring bears against the first lever 54 and its end 57*e* is mounted in a coutout of the side wall 14. The return force of the coil spring 57 acts in the direction of the arrow $M_2$ (see FIG. 1). The second coil spring 58 is mounted between the inner surface of the right side wall 15, and the lever 55 so that it has an end 58*a* connected to lever 55 and another end 58*e* which is mounted in another cutout of the rear side wall 13. This spring has a return force in the direction of the arrow $M_1$. In order to actuate the splint teeth coupling 56 there is arranged on the coupling member 56 a non-illustrated releasing means. An adjusting member 70 extends immediately contiguous to the longitudinal cover 11 in the direction of the longitudinal axis of the weapon. This adjusting member 70 includes a base plate portion 71, having a first cam portion 72 in its forward region and a second cam portion 73 *l, r* and lastly an adjustment cutout portion 74. The base plate 71 is, when viewed in plan, of substantially rectangular cross section. It has along both of its longitudinal sides guide surfaces 75 *l*, 75 *r* which are disposed in mating grooves 17 *l*, 17*r* in the corresponding side walls 14, 15 of the housing 10. The base plate 71 supports in its forward region on the side facing the inner space 16 the first cam control portion 72. This cam portion 72 extends in the shape of a prismatic element, having a rectangular-triangular cross section, transversely to the longitudinal axis of the weapon, whereby the inner surface of the forward front wall 12 of the housing 10 faces a side of the control cam portion 72 which forms the short side of the rectangular triangle of the cross section thereof. The upper side 72*f* of the control cam portion 72 forms the hypotenuse of the afore-mentioned triangle. This upper surface 72*f* coacts with the control surface 34 of the catch lever 30. In the mid region of the rearwardly extending portion of the base plate 71 there are provided two rectangular, mirror-like arranged cutout portions 77 *l, r* adapted to receive the two halves 73 *l, r* of the second cam portion 73. Both cutouts 77 *l, r* are provided at their front sides with the corresponding stop surface 78 and at their rear side with a corresponding counter-stop surface 79. The mirror-image arranged halves 73 *l, r* of the second cam control portion 73 complement substantially the rectangular cross section of the base plate 71 and are shaped as prismatic elements with a corresponding entraining surface 80 and a rearwardly upwardly inclined reflecting surface 81 which extends up to a surface 82, which is parallel to the bottom plate 11. The cam control element 73 *l, r* is further provided with a spring stop surface 83 which is parallel to the front surface 80. The exterior lateral sides of the cam control portions 75 *l*, 75 *r* are provided with guide ridges 75 $l_2$, 75$r_2$ for guiding these cam control portions in the corresponding grooves 17 *l*, 17 *r*. There extend parallel to the longitudinal axis of the weapon guide bolts 84 which coact with counter surfaces 79 and are disposed in the corresponding cutouts 73 of the cam control portion. There is disposed between the countersurface 79 and the spring surface 83 facing said counter surfac 79 a pressure spring 85 embodied as a forward moving spring. This pressure spring 85 presses the surface 80 resiliently against the corresponding entraining surface 78 of the adjusting member 70. In the rear region of the base plate 71 there is arranged the adjusting contact member 74 for the free end of the first lever 54 of the bolt 50. Both halves 73 *l, r* of the second control part 73 are moveably mounted in the cutout relative to the base plate 71 in a direction parallel to the longitudinal axis of the weapon.

The control arrangement 70 is adjustably arranged in the inner space 16 between the two end walls 12 and 13.

The cam control portion 72 of the adjusting member 70 coacts with the guide surface 34 of the catch lever 30 and the second cam control portion 73 of the adjusting member 70 coacts with the second control surface 35 of the catch lever 30.

The manner of operation of the servo-release mechanism is as follows:

The breech body 20 is, in the catch position as illustrated in FIG. 1. Its catch shoulder 24 abuts against the catch surface 37 of the catch lever 30. The adjusting surfaces 82 position the adjusting cam 36. The end surface 80 is, as can be seen in FIG. 3, positioned in front of the corresponding entraining surface 78. The adjusting member 70 is positioned in a forward end position and is maintained in this position by means of the first lever 54 of the coupling member 50 engaging into the cutout 74 of the adjusting member 70. There exists a form lock between the first lever 54 and the second lever 55, whereby the second lever 55 abuts along the transfer region between the support surface 21 and the deflection surface 22, against the breech body 20. The coil spring 58 which forms jointly with the beginning and end parts 57*a*, 57*e* the storage spring F, is now loaded. A non-illustrated safety slider arrests the coupling member 50 and prevents a lifting of the form lock between the two levers 54 and 55. The weapon is now ready to be fired and is also secure. In order to open fire, the safety slider is slid out of its arresting position. Then a non-illustrated trigger lever is actuated. Thereby a non-illustrated energy converter, for example a solenoid, is brought into operation and an also non-illustrated releasing means releases the coupling member 50 by lifting the form lock between the levers 54, 55. The energy which has been stored in the storage spring F is now released, whereby the first lever 54 adjusts the adjusting member 70 in the direction towards a rear end position. Thereby there is first of all disrupted the adjustment contact between the adjusting cam 36 and the adjusting surface 82. A further advance of the second cam portion 73 along the adjusting path causes that the first control portion 72 of the adjusting member 70 to impact with a predetermined velocity onto the first control surface 34 of the catch lever 30 and thereby imparts a control impulse to the forward arm 32 thereof in the direction towards the breech body 20. The catch lever 30 is caused to pivot clockwise, and the bearing surface contact between the catch surface 37 and catch shoulder 24 is suddenly lifted and the stored energy in the non-illustrated closing spring, which is used for causing a forward motion of the breech body 20 in a direction of the arrow $M_1$, is now released. Simultaneously, and in accordance with FIG. 2, the adjusting member 70 reaches its rear limit position; the first cam control portion 72 is now positioned underneath the first control surface 34 of the catch lever 30 and the second control lever 55 now swings with its free end in a counter clockwise direction due to the return force of the coacting return spring 58*a*, *e*, into the path of movement M of the breech body 20. As long as the trigger lever is actuated, the two levers 54 and 55 are maintained mutually uncoupled from each other, which prevents an actuation of the splint teeth coupling 56 and thereby the formation of a form lock. The automatic weapon is now in a continuous firing mode. During continuous firing the lever 55 is pivoted in the clockwise direction by means of the recoiling breech body 20 against the return force of the coil spring 58 having the ends 58*a*, *e* and thereafter pivots, after being contacted by the passing breech body 20 against the return force of the coil spring 58 again in the counterclockwise direction due to the fact that its free end is situated in the path of movement M of the breech body 20. Thus the lever 55 alternates during continuous firing between the positions illustrated by the curved double arrow in FIG. 2.

In order to interrupt the firing of the weapon the actuation of the trigger lever is ended. Thereafter there occur the hereinafter described steps in the following obligatory sequence: Both levers 54 and 55 are moved proximate to each other and as soon as the recoiling breech body 20 with its deflection surface 22 turns the lever 55 clockwise by biasing the coil spring 58 wth its ends 58*a*, *e* into a predetermined angular position with respect to the lever 54, the form lock between the two levers 54 and 55 is re-established. The lever 54 is now deflected in the clockwise direction against the return forceof the coil spring 57 with its ends 57*a*, *e* and imparts onto the adjusting member 70 in its forward end position (FIG. 3) a forwardly directed adjusting momentum. During the adjustment path of the adjusting member 70 towards its forward limit position (see FIG. 3) there is first of all lifted the first bearing surface contact with the first adjustment surface 34 of the catch lever 30. Thereafter the deflecting surfaces 81 impact surge-like onto the second control surface 35 of the control lever 30. Due to this impact surge, the catch lever 30 is pivoted counterclockwise, until its bearing region 38 contacts the bearing surface 21 of the recoiling breech body 20. The second control surface 35 now forms a yielding bias against the second control body 73 *l*, *r*, acting against the return positioning force of the counter coil spring 85 deflecting the second cam portion 73 opposite to the adjustment path of the adjusting member 70. During the further recoil motion of the breech body 20 the bearing surface 21 leaves the bearing region 38, whereby the braking contact between the second control surface 35 and the second control body 73 *l*, *r* breaks down, whereby the energy stored in the counter coil spring 85 is suddenly released and the force of spring 83 pushes the front face 80 against the entraining surface 78. The deflecting surfaces 81 now impart onto the second control surface 35, a corresponding impulse, whereby the pivoting of the catch lever 30 in the counterclockwise direction is suddenly continued, and its catch surface 37 arrives in the region of the cutout 23 in the path of movement M of the breech body 20 and the adjusting surfaces 82 adjust the adjusting cam 36, so that after its reversal of motion at the rear end of its path of movement M the breech body 20 with its catch shoulder 24 is prevented in a secure and reliable manner by the catch lever 30 to further move forward by engagement with the catch surface 37 (catch position in accordance with FIG. 1). The breech body 20 therefore is controlled by the catch lever 30 in a forcible manner.

When it is desired to fire a single shot, the trigger lever is actuated only for a short period of time. This is accomplished by lifting of the form lock between the levers 54 and 55 (loosening the coupling member 50 by disengaging the coupling 56) the breech body 20 is released in the afore-described manner and impacts during recoil on the lever 55 which is form locked with lever 54, so that after its reversal of movement it is immediately securely held in its catch position (see FIG. 1).

The afore-described description makes the following apparent:

The servo-release in accordance with the invention encompasses in an advantageous manner only a very reduced number of individual parts, which moreover are of simple and rugged construction and are furthermore also insensitive to severe tolerance requirements for purposes of affording a precise coaction. Some of the individual elements of the release mechanism are advantageously capable of performing a plurality of functions, such as for example the control body 73 *l, r*. Thus, for example a double function can be accomplished at least by one of the spring storage means formed by the coil springs 57 and 58 in an advantageous manner; the springs can perform the function of axially acting return positioning springs for producing the form lock between the levers 54 and 55. Also it can act as the energy converter between the recoiling breech body 20 and the spring 57 having the ends 57*a, e* and the spring 58 having the ends 58*a, e* insofar as this is advantageous for the construction, in view of the fact that at the point of reversal of movement of the path of movement M there is only present a reduced energy, which can be superposed on the weapon motion.

There is furthermore provided the advantage in that not only is the force imput for uncoupling the coupling 50 (beginning of firing) very reduced, but also the specific surface pressures within the splint tooth coupling (56) is also very reduced. This reduction of forces makes possible a reduction in wear of the corresponding parts by constructing the spring storage means F out of a plurality of parts; the capacity thereof and/or arrangement can be adapted to different conditions and requirements. This brings about an increased security and safety of the device as well as to its capability of being adapted to different circumstances; for example the storage spring means F can, by incorporating a spring element between the forward front wall 12 of the housing 10 and an adjacent wall 7*a* of the adjusting member 70 (or between the rear face wall 13 and an adjacent limit 78) be modified in an advantageous manner. Finally, it can be considered as advantageous that the servo-release mechanism in accordance with the invention, in embodiments modified from those illustrated in the drawing, can also be mounted above the path of the movement of the breech body 20 by slightly modifying the arrangement. Consequently, the invention is intended to include such modification in automatic weapons.

A further advantage is rendered by the fact that the breech is loaded in a secure condition. A safety device (release lock) arranged transversely to the longitudinal axis of the weapon, prevents advantageously an inadvertent release of the coupling member 50 and an inadvertent firing as a result of impact blows, for example during transporting of the weapon.

Although the invention is illustrated and described with reference to a plurality of preferred embodiments thereof, it is to be expressly understood that it is in no way limited to the disclosure of such a plurality of preferred embodiments, but is capable to numerous modifications within the scope of the appended claims.

What is claimed is:

1. In an automatic firearm having a reciprocally movably mounted breech body with a catch surface, an improved servo-release mechanism, comprising in combination, a catch lever rockably mounted in said firearm and having a first arm adapted to be selectively moved to a first catch position and a second firing position, mechanical control means including an adjusting member slidably movably mounted in said firearm between first and second end positions and kinetic energy absorption means for receiving and storing a portion of the recoil kinetic energy of said breech body and imparting at least a portion of said stored kinetic energy to said adjusting member; said kinetic energy absorption means including an energy storing coil spring means and means associated with said coil spring means for selectively locking said coil spring means after said portion of said kinetic energy had been stored therein and selectively releasing said coil spring means to impart it onto said adjusting member;

said breech body having a first contact surface adapted to coact with said first arm of said catch lever and said adjusting member having second and third contact surfaces adapted to coact respectively with said first and second arms of said catch lever, said coaction between said second contact surface of said adjusting member and said first arm positioning said first arm in the catch position when the adjusting member is in the proximity of its first end position and the coaction between said third contact surface of said adjusting member and said second arm positioning said first arm in the firing position when the adjusting member is in the proximity of its second end position;

said energy absorption means having a second member adapted to coact with the recoiling breech body and a first member adapted to transmit the energy received from the recoiling breech body to said adjusting member.

2. In an automatic firearm, the improved servo-release mechanism as set forth in claim 1, wherein said adjusting member moves in a path parellel to the path of movement of said breech body, said energy absorption means further includes a shaft rigidly mounted in said firearm, said first and second members being rotatably and axially movably mounted on said rigid shaft, said coil spring means including first and second coil springs coaxially mounted on said rigid shaft and respectively operatively connected to said first and second members of said energy absorption means;

said first and second members having mating contact surfaces which when matingly contacting effect a force transmitting coupling.

3. In an automatic firearm, the improved servo-release mechanism as set forth in claim 2, and including biasing means operatively mounted in said firearm and coacting with said adjusting member to bias it toward said first end position.

4. In an automatic firearm, the improved servo-release mechanism as set forth in claim 3, wherein said second coil spring biases said second member into the path of movement of the recoiling breech body, said first member being in contact with said adjusting member during the entire firing cycle of said firearm and being biased by said first coil spring into such contact.

5. In an automatic firearm, the improved servo-release mechanism as set forth in claim 4, wherein said breech body has a rear impact surface which is adapted to contact said second member and to move it out of the path the recoiling breech body, said force transmitting coupling being effected at predetermined angular positions of said first and second members in which said first arm of said catch lever is in the catch position, the disengagement of said mating surfaces of the force transmitting coupling causes an energy release of the first coil spring to thereby move the adjusting member via the first member and the catch lever via the second contact surface of the adjusting member into the catch position.

6. In an automatic firearm, the improved servo-release mechanism as set forth in claim 5, wherein the forces of the first and second coil springs are added when the mating surfaces of the first and second members are matingly contacting.

* * * * *